US007159730B2

(12) United States Patent
Rumpel

(10) Patent No.: US 7,159,730 B2
(45) **Date of Patent: *Jan. 9, 2007**

(54) FOLDING CRATE WITH ARRAY CONNECTION FEATURES

(76) Inventor: Donald Rumpel, P.O. Box 549, Smelterville, ID (US) 83868

( * ) Notice: Subject to any disclaimer, the term of this patent is extended or adjusted under 35 U.S.C. 154(b) by 430 days.

This patent is subject to a terminal disclaimer.

(21) Appl. No.: 10/641,331

(22) Filed: Aug. 11, 2003

(65) Prior Publication Data

US 2004/0159659 A1 Aug. 19, 2004

Related U.S. Application Data

(63) Continuation-in-part of application No. 10/057,169, filed on Jan. 23, 2002, now Pat. No. 6,722,515.

(51) Int. Cl.
*B65D 8/14* (2006.01)
*B65D 21/02* (2006.01)
*B65D 8/18* (2006.01)

(52) U.S. Cl. ..... 220/7; 220/26.3; 220/4.26

(58) Field of Classification Search ..... 220/4.33, 220/4.34, 7, 23.6

See application file for complete search history.

(56) References Cited

U.S. PATENT DOCUMENTS

| | | | | |
|---|---|---|---|---|
| 1,360,880 | A | 11/1920 | Bucholtz | |
| 2,975,667 | A | 3/1961 | Bross | 85/36 |
| 3,809,279 | A | 5/1974 | Arjas | 220/21 |
| 4,044,910 | A | 8/1977 | Box | 220/7 |
| 4,062,467 | A | 12/1977 | Friedrich | 220/7 |
| 4,789,075 | A | 12/1988 | Sun | 220/4 |
| 4,827,609 | A | 5/1989 | Kawecki | 29/832 |
| 4,903,451 | A | 2/1990 | Gresswell | 52/584 |
| 5,088,619 | A | 2/1992 | Shank | 220/532 |
| 5,538,153 | A | 7/1996 | Marovskis et al. | 220/6 |
| 5,593,265 | A | 1/1997 | Kizer | 411/552 |
| 5,632,392 | A | 5/1997 | Oh | 220/7 |
| 5,853,099 | A | 12/1998 | Lessard | 220/7 |
| 5,967,356 | A | 10/1999 | Laarhoven et al. | 220/6 |
| 6,073,790 | A | 6/2000 | Umiker | 220/6 |
| 6,216,872 | B1 | 4/2001 | Haasbroek | 206/512 |
| 6,386,388 | B1 | 5/2002 | Overholt | 220/608 |
| 6,405,888 | B1 | 6/2002 | Overholt et al. | 220/6 |
| 6,409,037 | B1 * | 6/2002 | Lin et al. | 220/4.34 |
| 6,722,515 | B1 * | 4/2004 | Rumpel | 220/6 |

* cited by examiner

*Primary Examiner*—Jes F. Pascua
*Assistant Examiner*—Shawn M Braden
(74) *Attorney, Agent, or Firm*—Gregory I. P. Law; Randy A. Gregory

(57) ABSTRACT

Folding crates includes a base and pivotable side walls which fold open from a stacked storage condition in which the walls are in juxtaposition and within the perimeter of the base. Latches are provided to connect the open walls and provide support between the walls. A pedestal and legs on the base are arranged so that the pedestal of one crate may be received and secured by the legs of a similar crate with side walls folded to the stacked storage condition. Crate connection assemblies are included for joining multiple crates into a crate array when the crates are open. The connection assemblies use receiver sockets that receive connection links therein. The links are preferably tubular to allow a tension fastener to extend therethrough and be secured by a septum wall against which the tubular links abut. The connection links provide compression transfer and resistance to shearing action between conjoined crates.

11 Claims, 11 Drawing Sheets

FOLDING CRATE WITH ARRAY CONNECTION FEATURES

CROSS REFERENCE TO RELATED APPLICATION

This application is a continuation-in-part of original U.S. patent application Ser. No. 10/057,169 filed Jan. 23, 2002 U.S. Pat. No. 6,722,515 and priority thereon is claimed under 35 USC §120.

TECHNICAL FIELD

The field of the inventions described herein relate to collapsible crates that fold between open operative and closed storage conditions, particularly collapsible crates which can be converted for use and be connected together to form arrays, such as display or container arrays.

BACKGROUND OF THE INVENTION

Wood and plastic crates have long been used for storing or supporting goods for transport. Crates even find use as display tools. Stacks of crates are often used in commercial establishments as display racks. However, unless the crates fold flat, large areas are required for storage. Empty crates require the same storage space as full crates.

Similar problems occur in industries where crates are used for transporting and storing goods. For example, in the dairy industry it is common practice to use molded plastic crates to hold groups of milk containers. One typical form of crate is designed to hold four one gallon milk containers in a rectangular array. While the crates are useful for retail stocking and warehouse handling, problems are encountered when the crates become empty. The crates are designed to be strong and durable, to support the weight of the milk containers. However, empty crates are no longer useful and take up valuable storage space. Disposal is not an alternative since the crates are costly and can readily be re-used.

Problems are realized once again when the empty crates are to be transported. The volume occupied by the empty crates is excessive in relation to the typical payload capability of the cargo carrier. Thus, a cargo van filled with empty crates is not efficiently utilized, and transport becomes a frustrating expense because the cost to transport empty crates is very near the cost to transport the filled crates.

The above problems have been realized and various solutions have been proposed. One considered solution is to make the crates in such a manner that their side walls may be folded to a flat condition. Another is to build the crates in such a manner that they may be dismantled to permit stacking in a more compact condition.

A need remains for a folding crate that may facilitate effective latching of the side walls in the open condition, which may be folded to a compact storage condition and which may be interconnected with other like crates for storage and display purposes.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
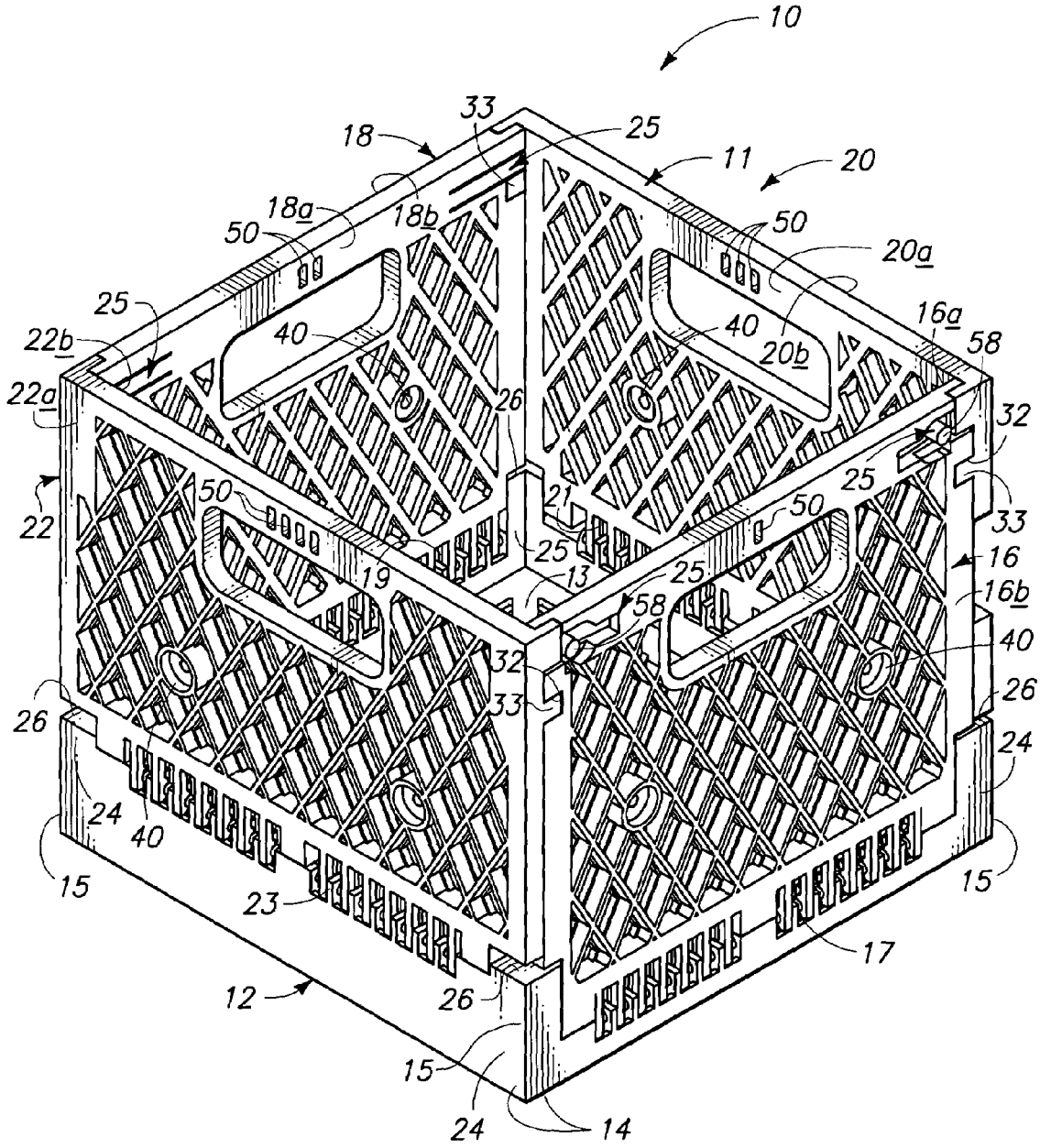
FIG. 1 is a perspective view of a foldable crate incorporating aspects of the present invention and which is shown in an open operative condition.

Before describing details of preferred elements and operations, a general description will be given of basic aspects of the crate.

In one aspect, the folding crate 10 is comprised of a base 12 having a perimeter 14. Side walls 16, 18, 20, 22 are pivotably mounted to the base 12 and fold from an open operative condition to a stacked storage condition in which the sidewalls are in juxtaposition and within the perimeter of the base, forming a stack having a stack thickness T (see example in FIG. 16).

Crate 10 includes upstanding legs 24 which are positioned about the perimeter 14 and project to ends 26 that are spaced from the base 12 by a dimension D greater than the stack thickness. A bottom pedestal 28 is provided on the base 12 in opposition to the legs 24 and is situated inward of the perimeter 14. The pedestal 28 and legs 24 are spaced such that the bottom pedestal 28 of one crate may be received between and secured by the legs 24 of a similar crate 10 with its side walls folded to the stacked storage condition.

In a second aspect, folding crate 10 includes a base 12 with a first pair of side walls 16, 18 pivotably mounted to the base 12 and which fold from an open operative condition to a stacked storage condition. A second pair of side walls 20, 22 are also pivotably mounted to the base 12 and fold, from an open operative condition adjoining the first pair of side walls to form a wall enclosure having an open top end 11, to a stacked storage condition in juxtaposition with the first pair of side walls and the base. The first pair of side walls each include inner surfaces 16*a*, 18*a* (example illustrated in FIG. 1), outer wall surfaces 16*b*, 18*b*, and latch members 25 that are formed integrally between the inner and outer surfaces such that no part of the latch members 25 project beyond the inner and outer surfaces. The second pair of side walls 20, 22 each include inner and outer wall surfaces 20*a*, 22*a*, and 20*b*, 22*b*. Catch members 27 are formed integrally with the second pair of side walls and are positioned for releasable engagement with the latch members 25 to secure the first and second pairs of side walls 16, 18 and 20, 22 in the open operative position.

In another aspect, the folding crate 10 includes a base 12 and perimeter 14 with a first pair of side walls 16, 18 pivotably mounted to the base 12 and foldable from an open operative condition to a stacked storage condition within the perimeter 14. A second pair of side walls 20, 22 are pivotably mounted to the base 12 and fold from an open operative condition adjoining the first pair of side walls 16, 18 to form a wall enclosure having an open top end 11, to a stacked storage condition within the perimeter 14 and in juxtaposition with the first pair of side walls and the base.

The first and second pairs of side walls define a stack thickness in the stacked storage condition. Upstanding legs 24 are positioned about the perimeter 14 and project to ends 26 spaced from the base 14 by a dimension greater than the stack thickness. A bottom pedestal 28 is provided on the base in opposition to the legs 24 and is situated inward of the perimeter 14. The pedestal 28 and legs 24 are spaced such that the bottom pedestal 28 of one crate 10 may be received between and secured by the legs 24 of a similar crate 10 with side walls thereof folded to the stacked storage condition.

In a preferred form, the first pair of side walls each include inner and outer wall surfaces 16*a*, 18*a* and 16*b*, 18*b*; and latch members 25 that are formed integrally between the inner and outer surfaces such that no part of the latch members 25 project beyond the inner and outer surfaces 16*a*, 18*a*; and 16*b*, 18*b*. The second pair of side walls each 20, 22 include inner and outer wall surfaces 20*a*, 22*a* and 20*b*, 22*b*; and catch members 27 that are formed integrally therein and positioned for releasable engagement with the latch members 25 to secure the first and second pairs of side walls in the open operative position.

In a further aspect, the folding crate 10 includes a base 12, first and second pairs of side walls 16, 18 and 20, 22 pivotably mounted to the base and foldable from an open operative condition to a stacked storage condition. Latch members 25 on the first pair of side walls 16, 18 and catch members 27 on the second pair of side walls 20, 22 are positioned to releasably interfit and releasably lock the first and second pairs of side walls in the open operative condition.

In some of the preferred forms of the invention, at least one of the walls includes features that form part of at least one connection assembly that allows one or more similarly designed crates to be connected together. The connection assembly or assemblies have a portion formed in one crate that joins or connects with a similar portion formed in another crate. The mating portions of the crates are placed into juxtaposition and joined to provide two or more conjoined crates.

In a preferred form of the invention the crates include one or more connector receivers 40 positioned on a wall for interconnection with a similar connector receiver 40 on a wall of a similar crate 10. Further the invention may include multiple connector receivers 40 in walls, such as the side walls shown.

As shown, the preferred connector receivers 40 are in the form of at least one receptacle. The receptacle or receptacles of the connection feature portions of the crates advantageously include one or more receiver socket portions used to receive a connector link or links 41.

Figure 8:
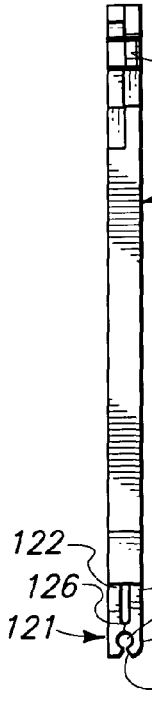
FIG. 8 is an end elevation view of a side wall.

The connection features also advantageously include an abutment wall formed by a septum 143 (FIG. 8) against which the connector link or links 41 abut. The depth of the receiver sockets and connector link or links are coordinated so that when the link or links are installed between adjacent crates the links maintain proper spacing to carry compressive forces between the conjoined crate walls using the links 41.

As shown, a single link member 41 is received in the connection socket 142 (FIG. 19) of the connector receiver 40. The link member 41 is also received in a similar fashion in a connection socket of an adjacent similar connector receiver 40 of the other crate 10 which is to be adjoined thereto. In preferred forms the link member or members can be releasably received in the connection receiver sockets. Alternatively, the link member or members may be received in a manner which produces a small degree of friction which keeps the link in place in the receiver 40 for easy coupling of an adjoining crate. This can be done by making the link approximately the same size as the socket portion. In either alternative, the link member and receiver socket may desirably be made complementary. This may be done by making these mating parts of the same cross-sectional shape. Alternatively, this may be accomplished by making the link capable of fitting within the receiving socket 142 but in a different shape. In either of the various forms the link is more advantageous if it is shaped and sized to be approximately centered or otherwise laterally positioned within the adjoining receiver sockets to maintain a lateral position therein which prevents displacement between the conjoined crates.

Preferred connection assemblies also use a tension member or members to secure a wall of one crate to an adjacent wall of another crate to provide adjoining walls of a crate array. The at least one tension member prevents separation of the walls should forces be experienced by the walls which produce a tendency to separate the conjoined walls. As shown, the tension member can be in the form of a fastener 46. Fastener 46 is advantageously received through the connection link or links 41. As shown, fastener 46 is receivable through the connector receiver, link member, and the similar connector receiver on the other crate to fasten the crates together.

Figure 2:
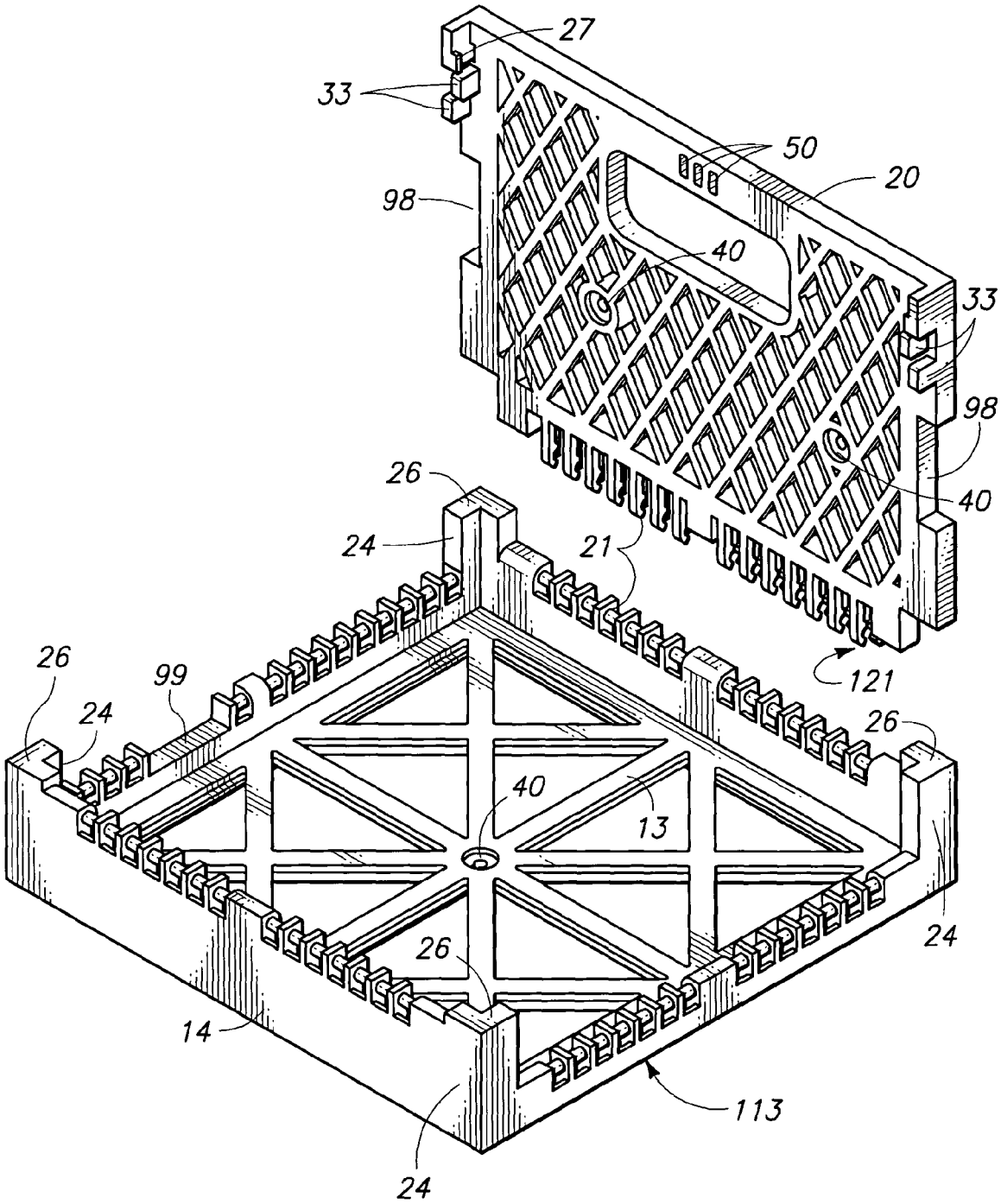
FIG. 2 is a fragmented perspective view of a base and one side wall removed therefrom.

Referring now in more particular detail to preferred components of the crate 10, reference will be made to particular details regarding the base 12. FIG. 2 illustrates base 12 as including a perimeter 14. The perimeter of base 12 is defined by basal walls having outer surfaces which define the outer surface which is the perimeter 14.

Figure 15:
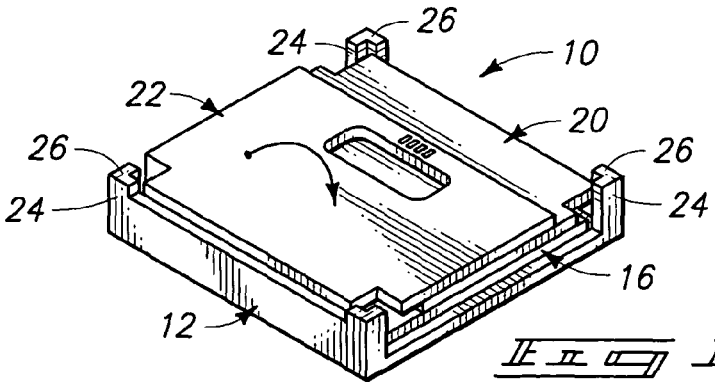

The basal perimetric walls are provided with hinges 17, 19, 21, and 23. The hinges are formed near the perimeter at progressively spaced elevations or distances from the bottom surface 113 of the base bottom wall 12. The base bottom wall also has an inside surface 13. As shown, the hinges are progressively spaced from both the outside bottom surface 113 and the inside base surface 13 in order to facilitate juxtaposition of the side walls in the stacked storage condition, such as shown in FIG. 15.

The hinge axes are spaced so that hinge pivot axes have pivot axes spacings from one another which are approximately equal to the associated thickness dimension of the side walls. If the side walls vary in thickness then the spacings between pivot axes would vary accordingly. As shown, the spacing is approximately equal and the walls have approximately equal thicknesses.

Figure 16:
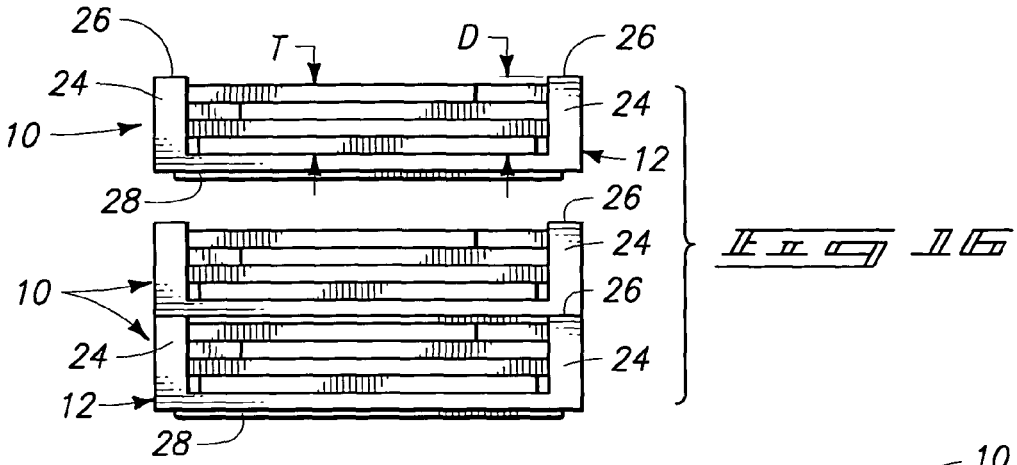
FIG. 16 is an exploded side elevation view of several similar folding crates being stacked, with the side walls thereof oriented in the stacked and folded condition.

The base also has legs 24 which are situated at the corners of the base and project upwardly from the top surface 13 to the leg top ends 26 which are spaced above the thickness dimension of the stacked side walls by a dimension D (see FIG. 16). The legs are situated at these positions and are spaced apart in order to receive a bottom pedestal 28 on the base of the next successive crate 10 in a stack (again refer to FIG. 16). Thus, the top ends 26 of the legs are spaced above the stack thickness by a dimension substantially equal to the thickness dimension of the pedestal 28. The legs are also spaced around the perimeter to receive the complimentary-shaped pedestal, thereby securing the next crate in a stack and allowing numerous crates to be stacked one on another in a nested column which resists laterally displacement and provides positional securement when in a nested array formation.

The crate base 12 also advantageously includes one of the crate connector receivers 40 which is integrally formed within the base material and is preferably situated as shown in FIG. 2 at the approximate center of the base. The crate connector receivers will be described in greater detail below following description of the preferred side wall arrangements.

Hinges 17, 19, 21, and 23 are formed between the base and the respective side walls. The completed or assembled hinges are formed such that one-half or part of the hinge is formed with the base and the other half or part of the respective hinge elements are formed in the side walls. Both the base part and side wall part of each hinge is preferably integrally formed with the base or side wall, respectively.

As shown, the hinges have a plurality of hinge clips 121. Each hinge clip preferably includes an inside clip arm 122 and an outside clip arm 123. The clip arms have tip extensions 124 and proximate extensions 126. Between the tip extensions and proximate extensions are recesses 125. Recesses 125 on the opposing inside and outside clip arms are in alignment to receive the hinge pins 127 (see FIG. 7).

The hinge assemblies are connected together by pressing upon the side walls with the hinge clips aligned with their distal mouths upon the hinge pins. Force is applied sufficient to distort the hinge clip arms and open them sufficiently so that the clips pass over the hinge pins and the hinge pin segments are captured by the clip arms from the inside and outside by the inside and outside clip arms, respectively. The hinge pin is preferably divided into segments by the hinge pin support extensions 128.

In the illustrated example, the hinge pins 127 are formed along the base and the hinge clips 121 are formed along the lower edge of the side walls. However, the hinges could alternatively be formed in a reverse configuration, with the hinge pins 127 provided on the side walls and the hinge clips 121 formed upon the base.

Figure 17:
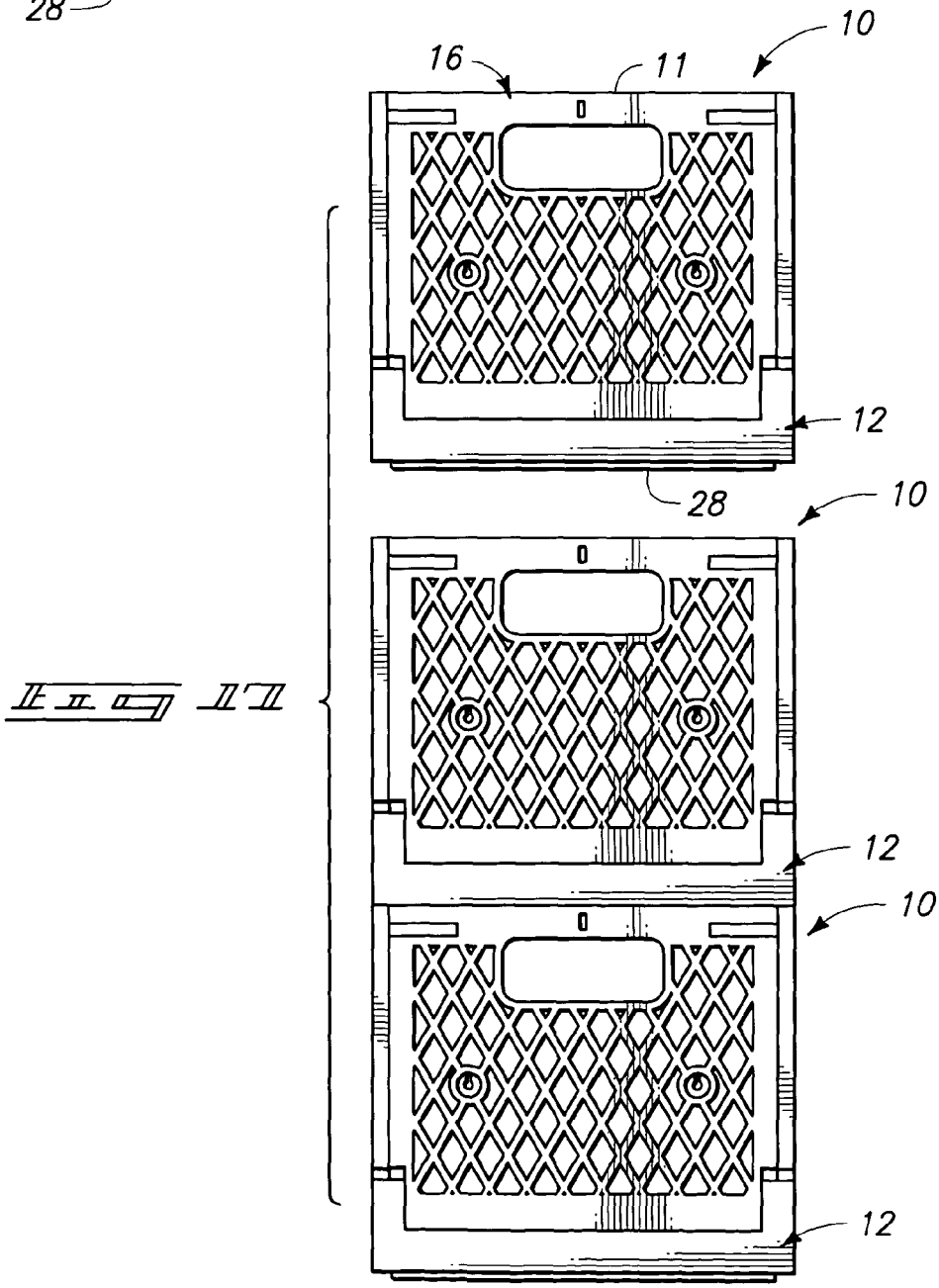
FIG. 17 is a view similar to FIG. 20 only showing the same crates being stacked when in the open operative condition.

It is preferable that the hinges be situated near the perimeter so the side walls, when opened, will define a top opening at the open top end 11 that is also complimentary to the bottom pedestal 28. Thus, a stack of opened crates may be formed in an open crate nested stack array as shown in FIG. 17 in the same manner as the collapsed or folded stack array as shown in FIG. 16. It is also possible to include folded and unfolded crates in the same stack array in nested stack relationship wherein the pedestal 28 extends within the inner confines of the upper portions of the legs 26.

Figure 3:
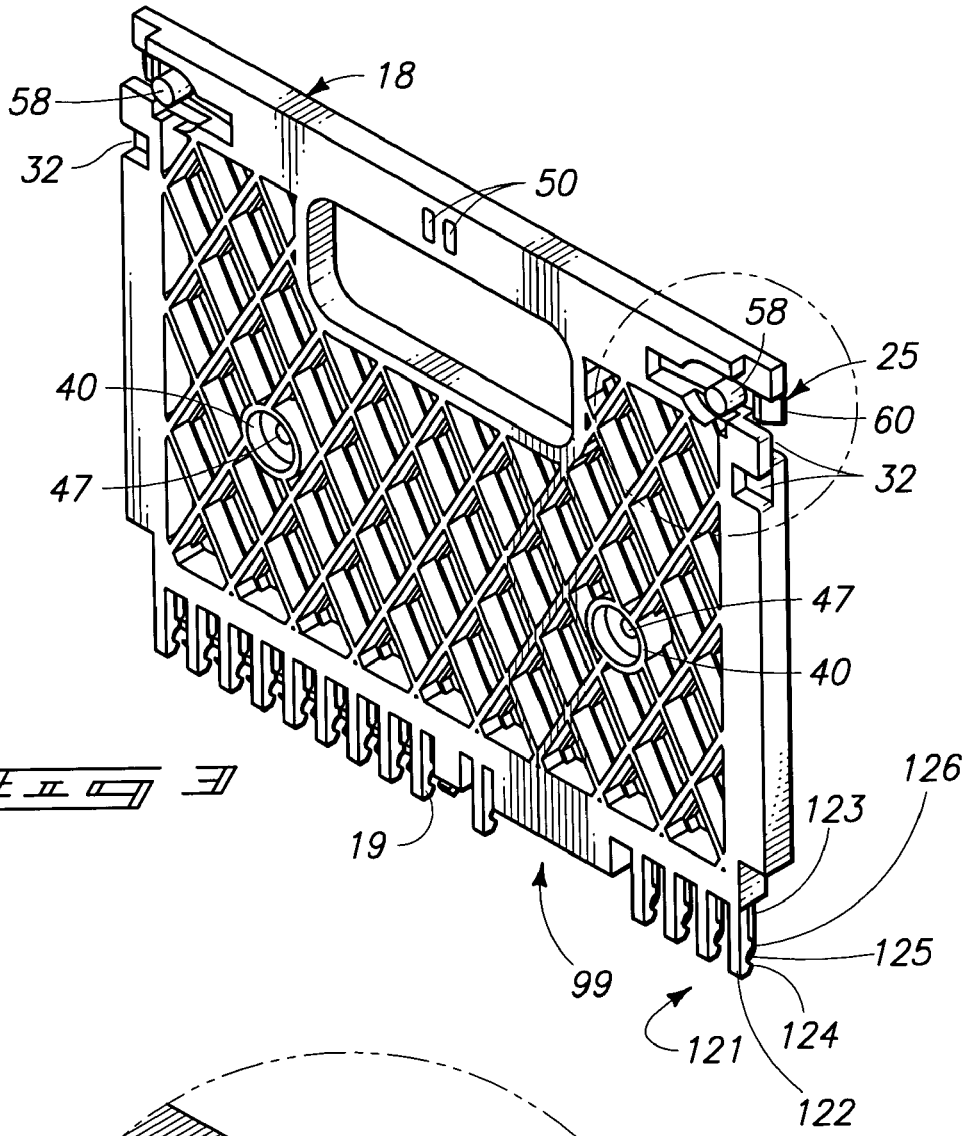
FIG. 3 is a perspective view of another side wall.
Figure 4:
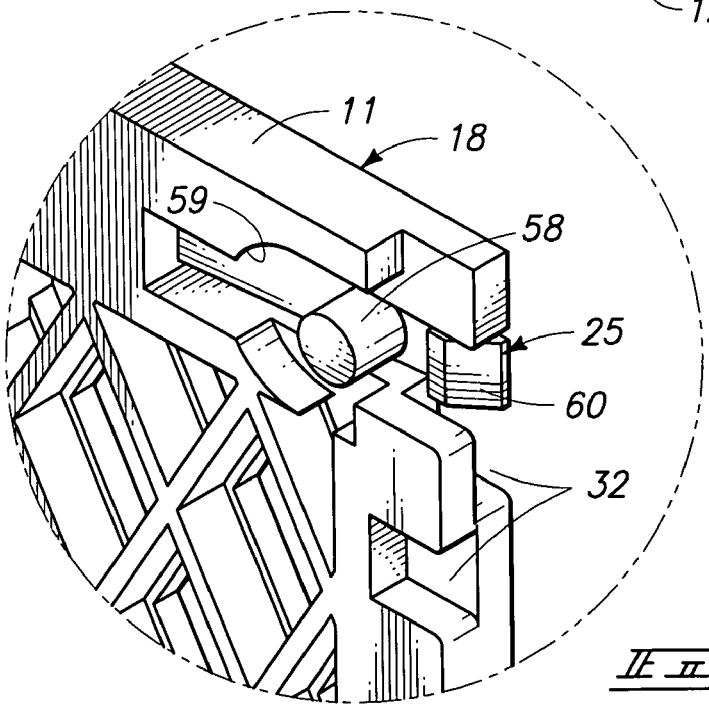
FIG. 4 is an enlarged perspective detail view of an area identified by a circular phantom line in FIG. 3.
Figure 5:
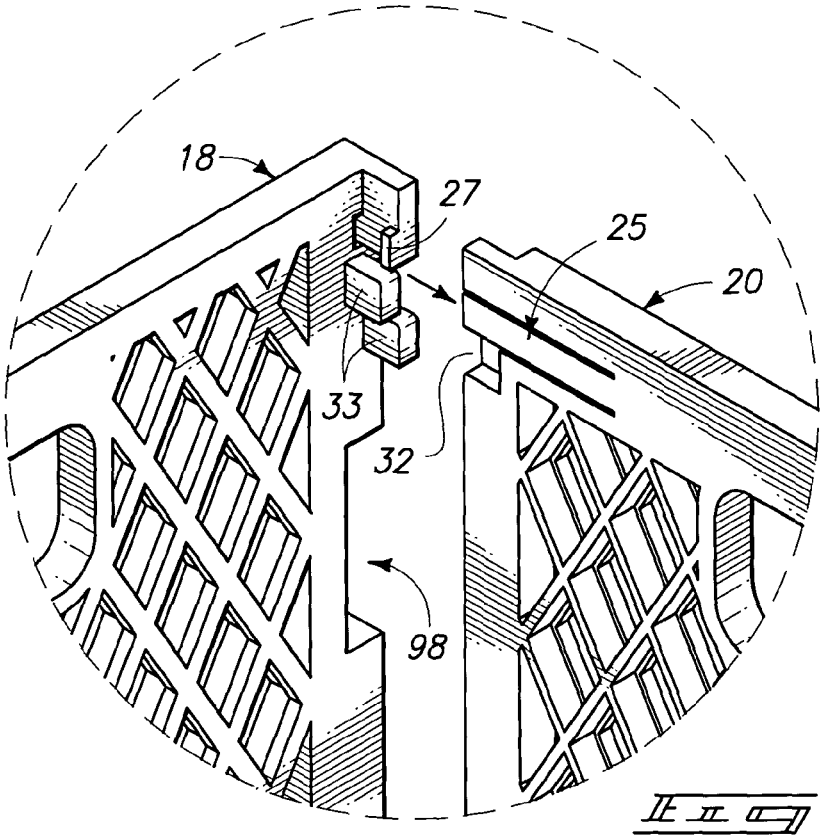
FIG. 5 is an enlarged detail perspective inside angle view showing two adjacent side walls about to be joined together.

Reference should now be made to the first pair of side walls 16, 18, a specific example of which is shown by detail in FIGS. 3 and 4. It is pointed out that the first pair of side walls 16, 18 are similar with differences being identifiable with respect to the side wall heights as determined by the necessary location of the hinge axes. Thus, the first side wall 16 will be greater in height from its hinge 17 to the top edge than the second side wall 18. The difference in height would be roughly equivalent to the thickness of the side walls between inner surfaces 16A, 18A, and the outer surfaces 16B, 18B.

The side walls are also advantageously provided with handle openings 150 to facilitate carrying of the crate. A variety of shapes are possible although the shape shown has been found preferable.

Other distinctive features between the first and second side walls 16, 18 may be provided in the form of indicia or markings 50. The first side wall 16 may include a single marking 50 to identify that wall as the first wall to be folded. The second side wall 18 may include two of the markings 50 to identify that wall as the second wall to be folded. Reference to FIG. 1 will show three markings 50 on the third side wall 20 and four on the fourth side wall 22. Such markings 50 identify the folding order of the walls to eliminate any possible confusion to those wishing to properly fold the walls to the closed, stacked condition.

The first pair of side walls which in the presently illustrated example are comprised of side wall 16, and side wall 18, also include the latch members 25. These members 25 are preferably positioned on opposite end edges of the side walls and are most preferably formed integrally therewith. The latches may be substantially identical and as such, description of one latch member will suffice for description of all four.

Figure 10:
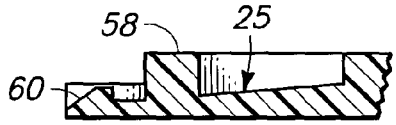
FIG. 10 is a sectional view taken along line 10—10 in FIG. 9.
Figure 9:
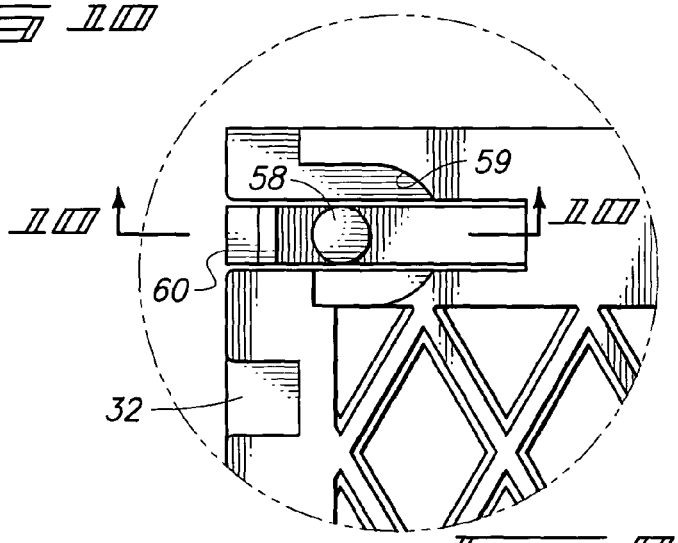
FIG. 9 is an enlarged detail view of the area within a phantom line circle in FIG. 7.
Figure 11:
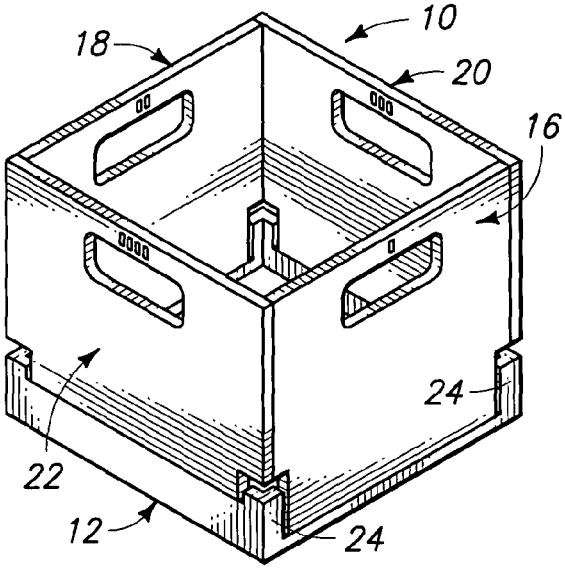
FIGS. 11–15 is a sequence of schematic views illustrating folding of the side walls from the open operational condition to the stacked folded condition.
Figure 12:
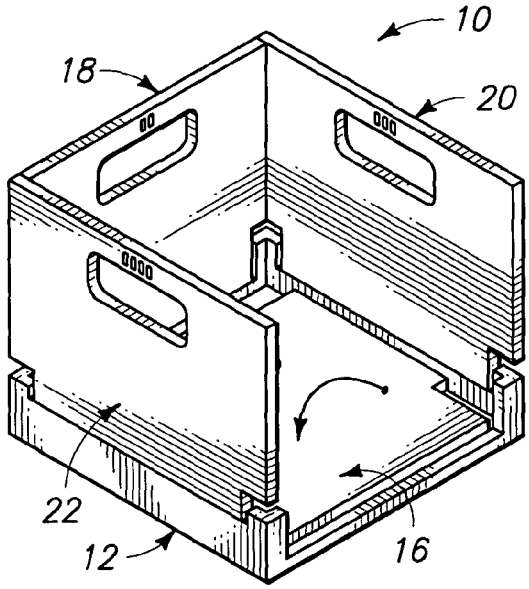
Figure 13:
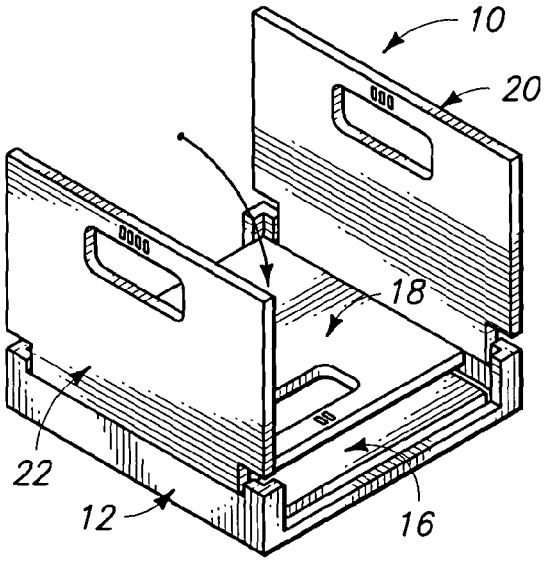
Figure 14:
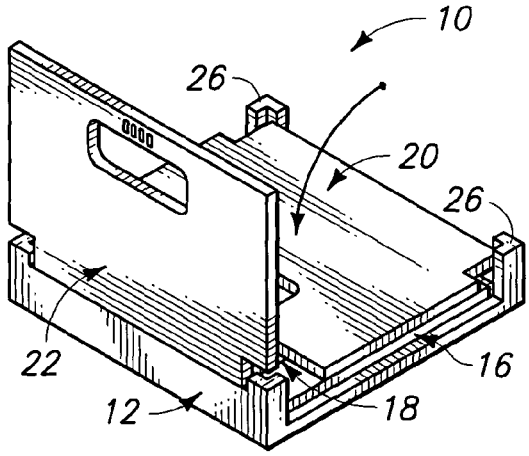

Attention is drawn to FIGS. 4, 9, and 10 which are illustrative of a preferred exemplary latch configuration. As shown and as preferred, the latch members 25 are formed integrally with the first and second side walls, preferably adjacent the upper edges thereof. The latch members 25 are most preferably yieldable and may be formed into leaf spring configurations formed by cutting away or otherwise relieving a portion of the side wall between the inner and outer wall surfaces, leaving a narrowing leaf spring configuration.

Each of the leaf spring shaped members may extend along the associated side walls to actuator members 58 that are disposed within associated recesses 59 that are formed in the first pair of side walls and that open along the outer surfaces thereof. The actuators 58 preferably do not project outwardly beyond the outer surfaces 16B, 18B of the side walls 16, 18. Thus, the first side walls present a substantially smooth outer surface that will not readily catch on other surfaces or present the actuators in such a manner that they couldn't be easily operated to disengage the latches from the catch members on the remaining two side walls.

The outward or free ends of the latch members are provided with cam or barb configurations 60 which are provided to cam or react against the catch members, springing the latch members inwardly as the second side walls are moved to the open condition. The catch members will engage and cam the latch members inwardly until they snap over the catch members and securely hold both wall sections in place.

Structural reinforcement is provided for the first and second pairs of side walls by provision of the mortise and tenon arrangements 32, 33. In the illustrated example, the mortise arrangements are provided on the first and second side walls, while the tenon arrangements are provided on the third and fourth (or second pair) of side walls. It is entirely conceivable that the mortise and tenon arrangement be reversed, or alternated between the respective side wall arrangements. However, it is preferred that some form of mortise and tenon arrangement be provided in order to strengthen and brace the respective adjacent side walls in the open condition.

Figure 6:
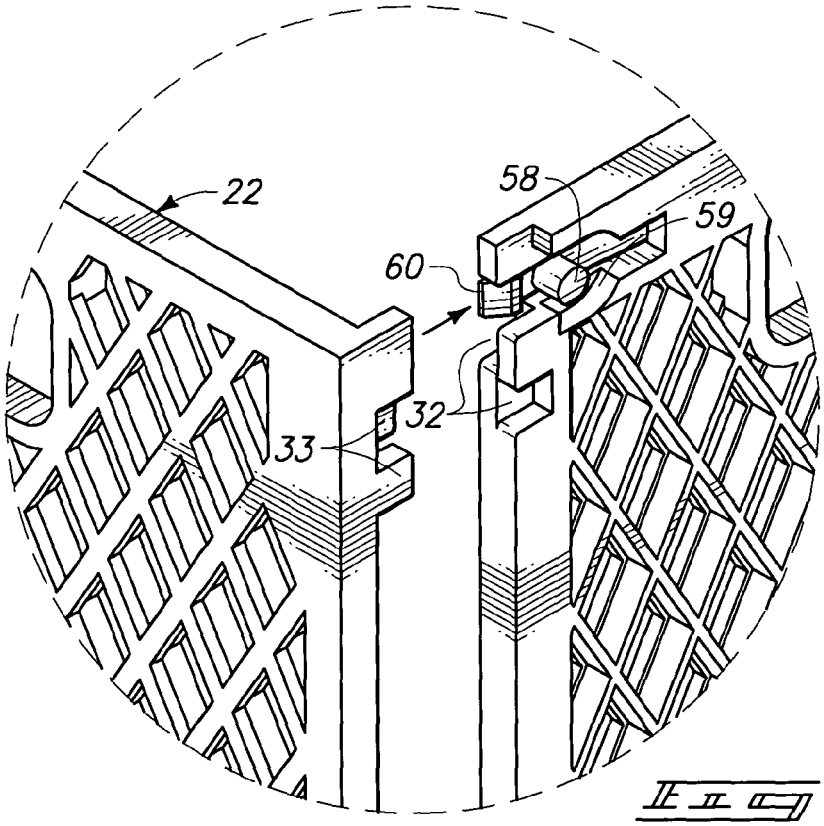
FIG. 6 is a view similar to FIG. 5 only showing the elements thereof from a different, outside angle.
Figure 7:
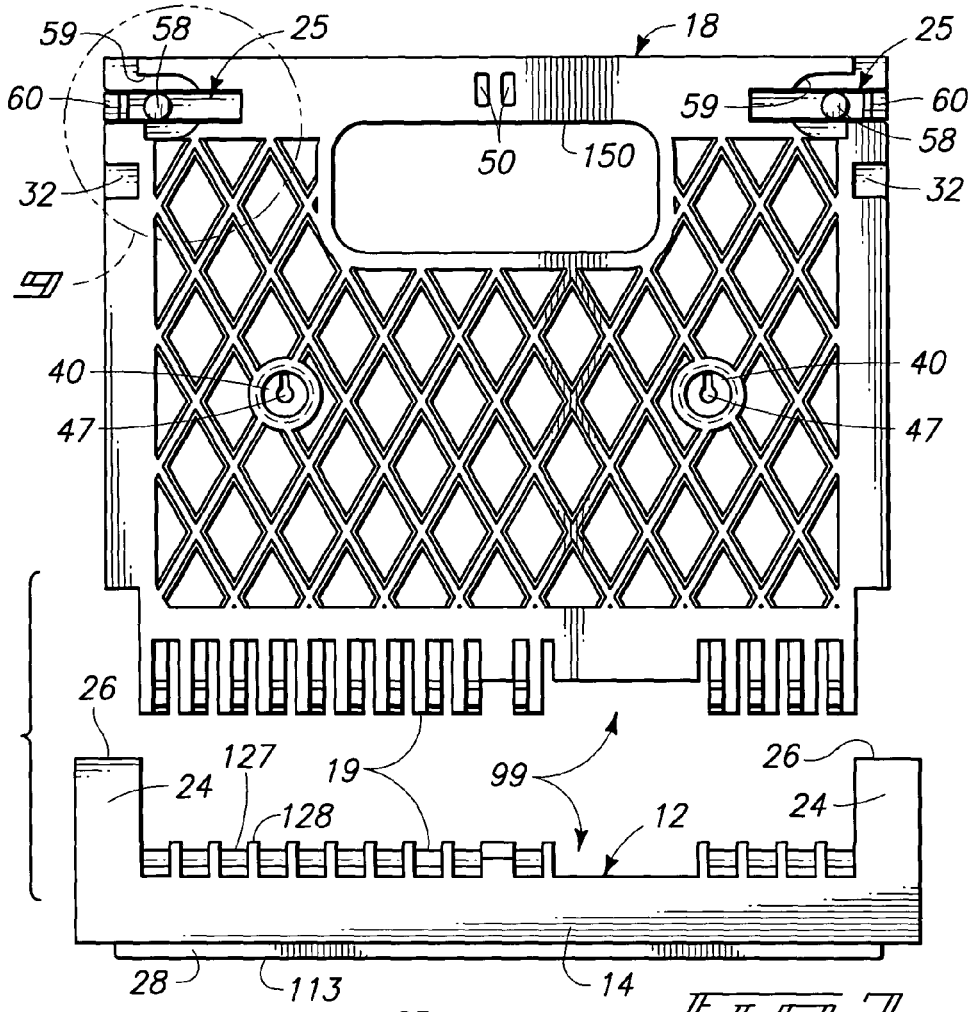
FIG. 7 is an exploded orthographic elevation of a side wall and the base.

The mortise and tenon configurations may take a substantially rectangular form as illustrated by the examples shown in FIGS. 6 and 7. Once again, however, other configurations could be utilized. Further, it is possible for the tenons and mortises to be reversed from the example shown.

It is pointed out that in the illustrated examples, the mortises are formed with one adjacent an outer wall and one adjacent the inner wall. The tenons are complimentary in position on the second pair of side walls 20, 22, thereby substantially sandwiching the first pair of side walls 16, 18 when the walls are interlinked in the open condition. The mortises and tenon arrangements fit snugly together when the side walls are situated in their interlocked, open condition, and the walls are thereby structurally braced.

In order to open the crate from a folded condition, the side walls are progressively pivoted about their respective hinge axes to the open condition. The second set of side walls may be pivoted just slightly outward of the latch members to facilitate alignment of the latch members with the catch members. When rough alignment is achieved, the second pair of side walls may be forcibly moved inwardly to engage the respective catch members 27 against the latch members 25, springing the latch members inwardly to snap over the catch members.

It is pointed out that once in the interlocked positions, the latch members 25 and catch members 27 do not project inwardly or outwardly of the adjacent inner or outer side wall surfaces. The preferred latch member actuators 58 are positioned to be normally flush or slightly inward of the outer side wall surfaces. The catch members 27 are also configured and positioned so as not to deflect the actuators 58 or other surfaces of the latch members 25 beyond the inner or outer surfaces of the first side wall pair.

Once the latch members 25 are effectively engaged with the catch members 27, the crate will be formed in a relatively rigid construction by the interlinked members (25, 27), and by the interfitting orientation of the mortise and tenon elements 32, 33. The result is a strong, rigid crate structure that will not easily become disengaged or accidently unlatched.

Reference is made to the schematic drawings in FIGS. 11–15, which show the procedure taken to shift the crate 10 from the open to the stacked, storage condition. Initially, the first side wall 16 is disengaged by depressing the associated actuators 58 to disengage the catches 27 of the adjacent third and fourth walls. This frees the first side 16 wall to fold inwardly into flush juxtaposition with the top surface 13 of the base 12.

The same procedure is followed for the second side wall 18. The second side wall 18 is disengaged from the third and fourth side walls and is folded into flush juxtaposition with the first, previously folded side wall 16. The folding procedure is repeated for the third and fourth side walls (which are now disengaged from the first and second side walls) to achieve the completely folded condition. The folded crate may now be stored or stacked in a very compact condition.

Figure 21:
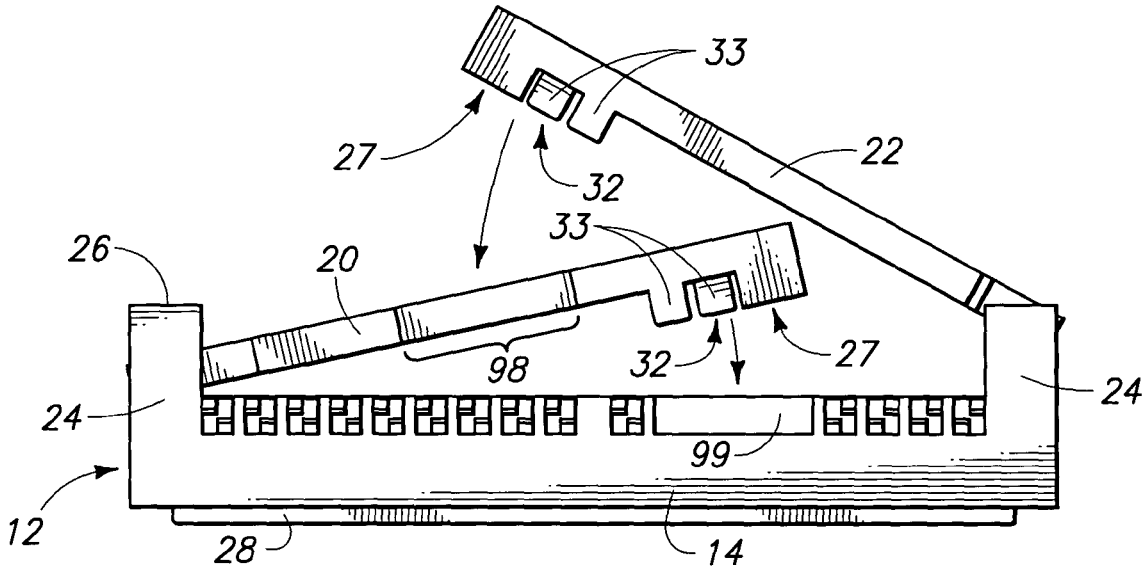
FIG. 21 is an elevation view showing two walls folded flat and two walls in the process of being folded downward.
Figure 22:
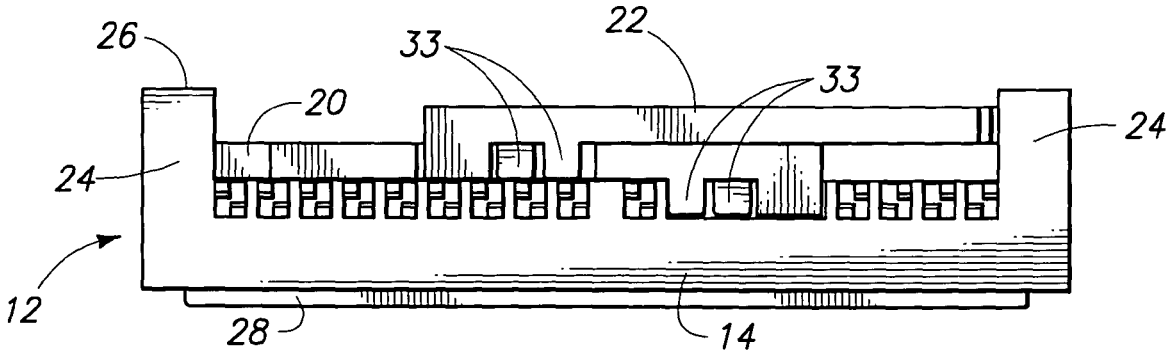
FIG. 22 is an elevation view similar to FIG. 21 with the two walls which were in process in FIG. 21 fully downward.
Figure 25:
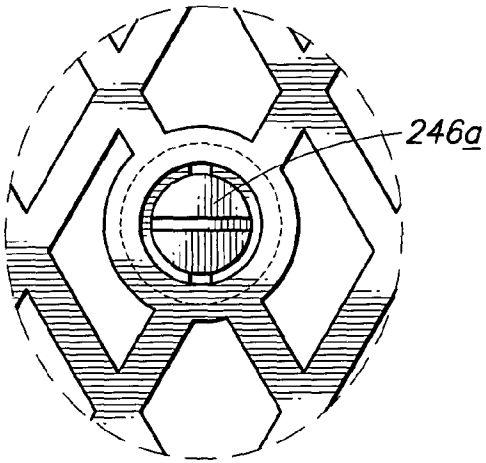
FIG. 25 is an right elevational view of the connection assembly construction shown in FIG. 23.
Figure 24:
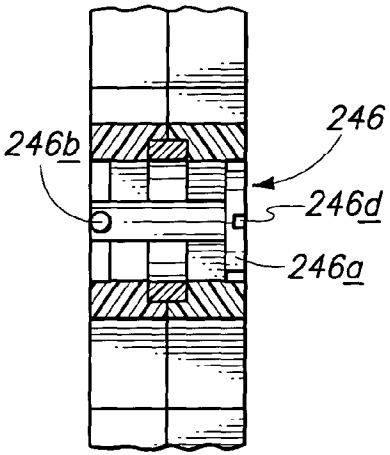
FIG. 24 is a left elevational view of the connection assembly construction shown in FIG. 23.
Figure 26:
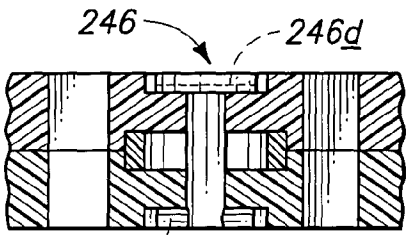
FIG. 26 is a cross-sectional view taken along line 26—26 of FIG. 23.
Figure 23:
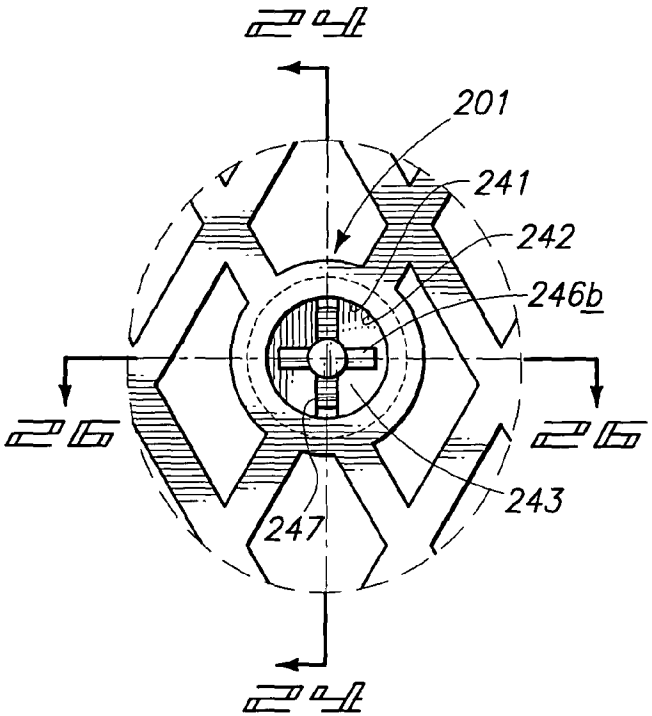
FIG. 23 is a partial cross-sectional view (analogous to FIG. 18) showing an alternative connection assembly construction according to another preferred form of the invention.

Movement into the completely folded or stacked storage condition is shown in greater detail in FIGS. 21 and 22. Tenons 33 project from the second pair of side walls 20, 22. The first pair of side walls may include pockets 98 (also see FIG. 2) which receive the projecting tenons 33 of fourth wall 22. Similarly, the tenons 33 of the third wall 20 fall into pocket 99 formed by second wall 18 and the hinge pins which mount the second wall.

Figure 20:
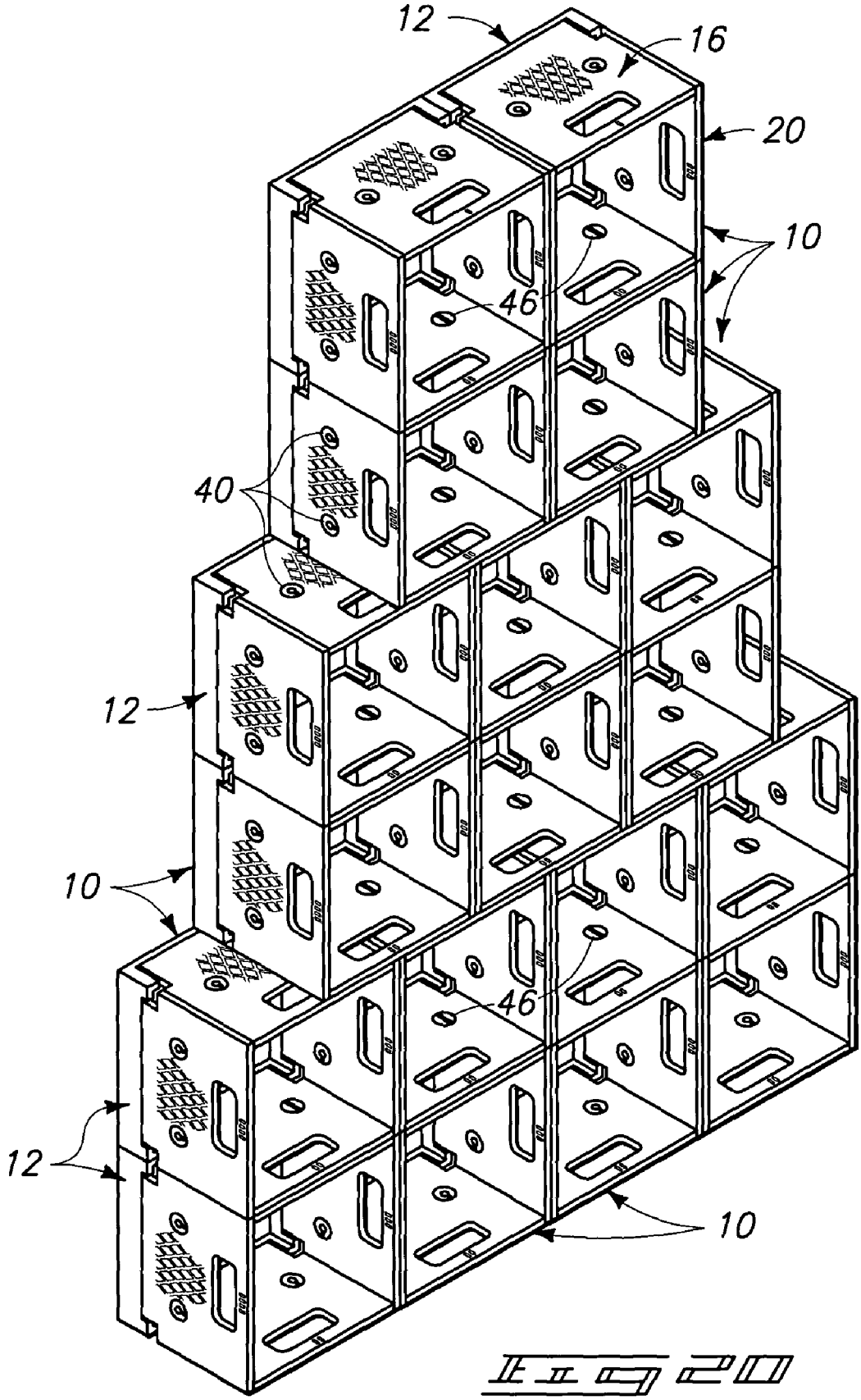
FIG. 20 is a diagrammatic perspective view showing a plurality of the crates arranged and joined together as a display.

As indicated earlier, the crate receivers 40 may be provided on the base and along any or all of the side walls. The receivers 40 are preferably formed as recessed sockets, molded into or otherwise formed into the side wall material. The receivers 40 are spaced identically and in such an arrangement that a succession of crates 10 may be aligned with one another, or otherwise oriented with the sockets in aligned, facing orientations. Aligned and facing receivers 40 of two crates may be interlinked or fastened together to secure the crates in a desired presentation as exemplified by the pyramid pattern shown in FIG. 20. This capability permits use of the crates as decorative storage or display devices.

Figure 18:
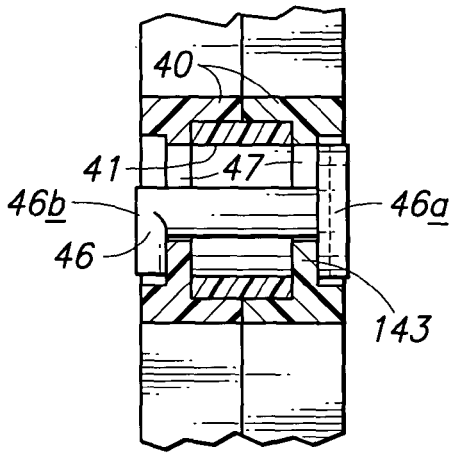
FIG. 18 is an enlarged fragmented sectional view showing connector receivers and a link for joining successive crates together.

The receivers 40 are shaped, as shown in detail by FIG. 18 to receive link members 41. The individual link member 41 may be of a tubular configuration that is complimentary to the socket configuration of the receivers 40. A link member 41 may be fitted into adjacent facing receivers 40 (FIG. 18) to lock the adjacent side walls (and crates) against relative motion with respect to one another in both the longitudinal and lateral directions relative to the link member axis. This is advantageously accomplished by abutment of the ends of the link members into the end of the receiver sockets.

Figure 19:
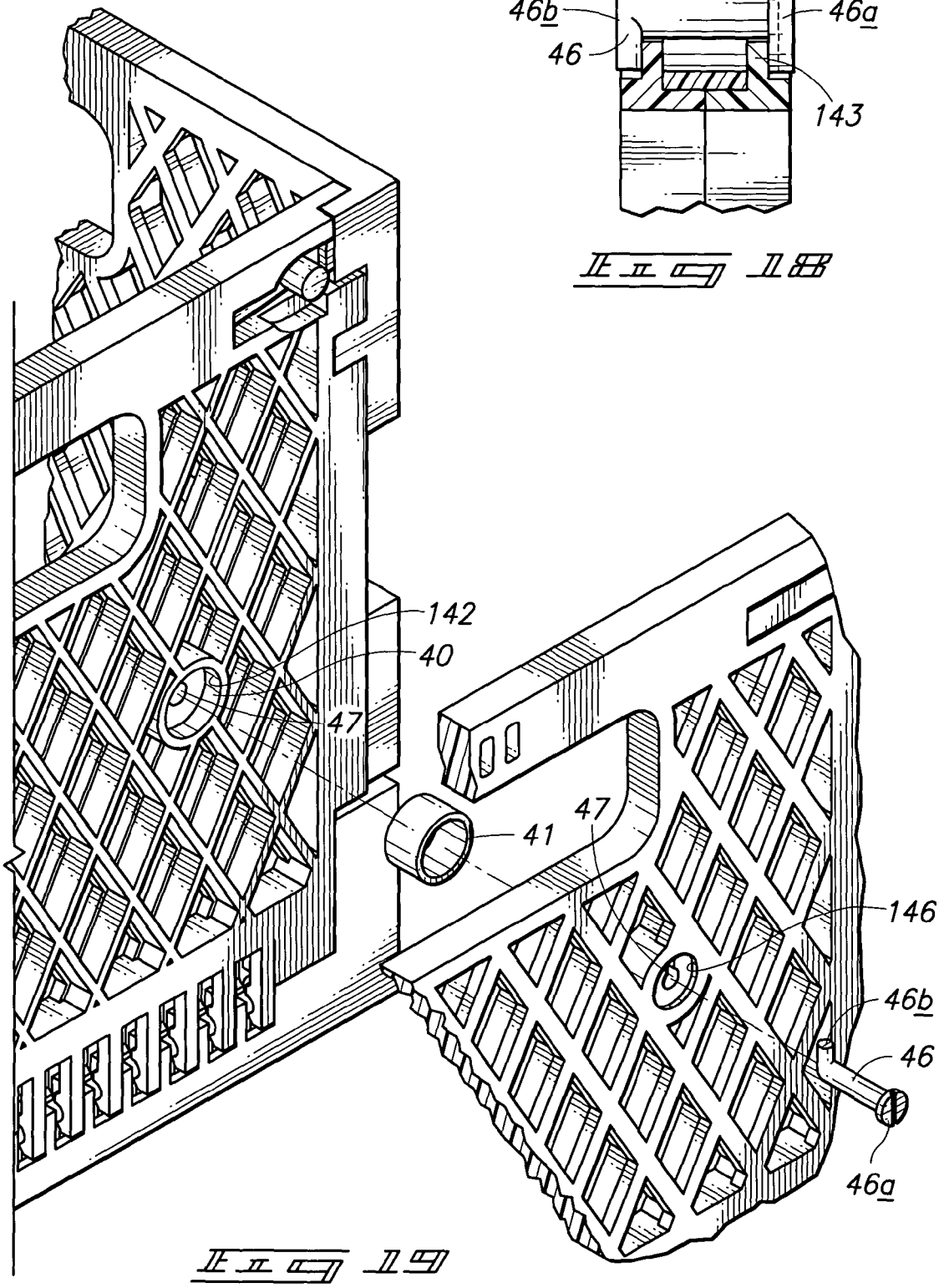
FIG. 19 is an exploded and enlarged fragmented perspective view showing a link and connector receivers along with a key fastener used to secure two crates together.

FIG. 19 shows that the inside wall of the crate includes connection features which preferably have a recessed area that receives the head of the tension fastener 46. The tension fastener in a preferred form is a J-hook type fastener which is received through the connection link 41 and is sized and shaped to fit through tension fastener holes 47 formed in the septum wall 143. The tension fastener hole is shaped to receive the end of the tension fastener therethrough. The J-hook fasteners 46 may include a slotted head **46*a* and an opposed hooked end 46*b*. The slots may be oriented in the heads 46*a* to be substantially parallel to the hooked end 46*b*** in order to identify the position of the hooked end to the user.

The hooked end **46*b* of a J-hook fastener 46 will fit through the aligned keyholes 47 of the adjacent crates. Once received through the aligned keyholes 47, the fasteners 46 may be turned such that the headed end 46*a* and hooked end 46*b*** substantially lock the crates together.

The outside and inside faces of the connection receivers 40 are preferably flush with the side walls and base and therefore do not interfere with normal functioning of the crates for normal, storage purposes. However, if it is desirable to utilize the crates as a display for retail or other purposes, it is a simple and effective procedure to lock the crates together using the integral receivers 40 and the interfitting link members 41, along with the J-hook devices 46 in the manner described above. Through the above provisions, an array or stack of interlocked crates can be easily and quickly assembled with reasonable assurance that the resulting structure will be fairly stable.

FIGS. 23–26 show an alternative construction for the crate connection assembly in the form of crate connector 201. Crate connection 201 is similar to the other form described hereinabove. Similar parts are numbered similarly using a 200 series number corresponding to the features described hereinabove. The receiver hole 241 is provide with a septum wall 243 which has a slotted tension fastener hole 247 passing therethrough. Tension fastener 246 has a head 246*a* which can be provided with a head slot 246*d* for applying torque with a conventional screwdriver. The inserted end of the tension fastener has a T-shaped head 246*b* which is passed through the slot-shaped receiver fastener hole 247.

The connection assembly also includes a ring-shaped or cylindrical tubular member 241 which is captured between the adjoined receiver sockets 242 and acts as the compression member against the septum wall 243. The tubular member also acts to resist shearing forces that can be generated by displace parallel to the parallel side walls of the adjoining crates. The tubular of other link member 241 must be sheared before displacement will occur.

In addition to the methods described above for opening the crates, the invention further includes methods for joining crates using the novel connection assemblies. The methods include installing the connection links into the connector receivers. The connection links may be installed in a first crate and then a second crate which is to be joined thereto is installed with the connection link extending from the first crate. The tension fastener is then installed by inserting the fastener through the fastener opening and extending the fastener until the hook portion of the fastener extends through the septum wall and is received in the opposing conjoined crate. The fastener is then secured by turning the fastener so that the hook portion is engaging the septum wall and prevents the fastener from being removed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus forming a folding crate which can be moved between an open condition and a closed condition and which may be connected to another of said apparatus configured in said open condition, comprising:

a base;

walls adapted for pivotal engagement with the base and capable of pivotal movement between said open condition wherein said walls are extended relative to the base to form a crate and said closed condition in which the walls are substantially parallel with said base to form a stacked arrangement upon the base;

engagement locks on said walls which may be released or locked; when locked, said engagement locks connecting between adjoining walls of said walls when the walls are in the open condition;

a plurality of connector receivers formed in at least one of said walls or base, said connector receivers having receiver sockets and holes which open through the walls or base;

at least one tubular link adapted to fit into said receiver sockets and be fixed against both longitudinal and lateral movement therein;

at least one fastener of sufficient length for extending through the holes, receiver sockets, and at least one tubular link to engage a wall of another said apparatus to allow joinder therebetween.

2. An apparatus according to claim 1 and wherein the receiver sockets are molded into the walls or base.

3. An apparatus according to claim 1 and wherein the walls include a plurality of connector receivers in each wall.

4. An apparatus according to claim 1 and wherein the walls include a plurality of connector receivers in each wall positioned to allow a single crate to be joined to two adjacent crates along a single wall.

5. An apparatus according to claim 1 and wherein an end of the at least one tubular link engages upon portions of the receiver socket to lock adjacent walls of conjoined crates against relative motion.

6. An apparatus according to claim 1 and wherein said holes are keyhole shaped holes.

7. An apparatus according to claim 1 and wherein said fasteners are J-hook type fasteners.

8. An apparatus according to claim 1 and wherein said fasteners have a hooked head that inserts through said holes.

9. An apparatus according to claim 1 and wherein said tubular links are cylindrical.

10. An apparatus according to claim 1 and wherein said tubular links install into the receiver sockets from outside the walls and have end surfaces which bear upon the walls within said receiver sockets.

11. An apparatus according to claim 1 and wherein said tubular links are complementary in shape to said receiver sockets.

* * * * *